United States Patent [19]

Deve

[11] Patent Number: 4,573,417

[45] Date of Patent: Mar. 4, 1986

[54] SAND RECLAMATION SYSTEM EMBODYING A COMBINATION THERMAL RECLAIMER AND SAND-TO-SAND HEAT EXCHANGER APPARATUS

[75] Inventor: Vagn Deve, East Washington, Pa.

[73] Assignee: Combustion Engineering, Inc., Windsor, Conn.

[21] Appl. No.: 605,086

[22] Filed: Apr. 30, 1984

[51] Int. Cl.[4] ..... F23D 14/00; F23G 5/00; F23G 5/12

[52] U.S. Cl. ..... 110/236; 110/245; 110/246; 241/DIG. 10

[58] Field of Search ..... 110/236, 246, 245; 241/65, DIG. 10

[56] References Cited

U.S. PATENT DOCUMENTS

| | | | |
|---|---|---|---|
| 2,452,362 | 10/1948 | Erisman | 241/DIG. 10 |
| 3,685,165 | 8/1972 | Deve | 110/236 X |
| 3,705,711 | 12/1972 | Seelandt et al. | 110/236 X |
| 3,841,240 | 10/1974 | Wenworth et al. | 110/236 |
| 4,487,372 | 12/1984 | Deve | 110/236 X |

*Primary Examiner*—Edward G. Favors

*Attorney, Agent, or Firm*—Arthur E. Fournier, Jr.

[57] ABSTRACT

A system for treating solid, granular and aggregate material thermally including a storage silo containing a supply of the material to be thermally treated. A combination thermal reclaimer and heat exchanger apparatus is connected in fluid flow relation to the storage silo for receiving material therefrom. The combination thermal reclaimer and heat exchanger apparatus is operative to both effect a preheating of material received thereby and to accomplish a thermal reclamation of the material received thereby as the material completes its passage through the combination thermal reclaimer and heat exchanger apparatus. A feeder device is cooperatively associated with the combination thermal reclaimer and heat exchanger means for receiving thermally reclaimed material therefrom. The feeder device has a transporter pipe cooperatively associated therewith into which thermally reclaimed material is fed. The transporter pipe is operative for transporting the thermally reclaimed material to a material storage device. While the material is being transported through the transporter pipe, the material is cooled to a predetermined temperature.

11 Claims, 8 Drawing Figures

SAND RECLAMATION SYSTEM EMBODYING A COMBINATION THERMAL RECLAIMER AND SAND-TO-SAND HEAT EXCHANGER APPARATUS

BACKGROUND OF THE INVENTION

This invention relates to systems of the type that are intended to treat solid, granular and aggregate material, and, more particularly, to a system embodying a combination thermal reclaimer and sand-to-sand heat exchanger apparatus in which there is accomplished the treatment by thermal reclamation of material, e.g., reclaiming spent chemically bonded foundry sand and clay bonded foundry sand.

As evidenced by a reference to the prior art, there have been attempts made previously in an effort to treat material by thermal reclamation. In this regard, the focus of one of these prior art attempts has been on an effort to effect the reclamation of foundry sand. One rationale behind this effort has been that if it were to prove possible to effect a recycling of the foundry sand, this would go far towards forestalling the exhaustion of existing sources of supply of foundry sand. Furthermore, to the extent that recycling of the foundry sand takes place at or in relatively close proximity to the individual foundry sites whereat the use was originally made of the foundry sand, the effect thereof would be to negate substantially, if not totally, the need to incur the expenses associated with the transportation of foundry sand from the sources of supply thereof to the foundry sites. In addition, the ability to reclaim used foundry sand obviates the problem associated with the need to find a suitable disposal site for the used foundry sand.

Insofar as the reclamation of used foundry sand is concerned, there are at least two major requirements, which from a practical standpoint, must be satisfied thereby. Namely, the used foundry sand after being subjected to the reclamation process must be in substantially the same condition as it originally was. That is, the reclamation process must be capable of returning the used foundry sand, in essence, to its original condition. Secondly, the reclamation of used foundry sand must be capable of being accomplished economically. More specifically, the cost of reclamation must be such that reclamation from a financial standpoint is sufficiently attractive to render it desirable to undertake the investment in terms of time, labor and money required thereby as compared to continuing to purchase new, i.e., not previously used, foundry sand.

With respect to this matter of the reclamation of used foundry sand, a variety of different types of apparatus have been proposed for use. These apparatus may, for ease of reference, be classified into categories according to the type of treatment to which the used foundry sand is subjected for purposes of effecting the reclamation thereof. Thus, one category of such apparatus is that of mechanical units. Here, reliance is had, generally speaking, on some form of abrasive action in order to effect the removal of, for example, organic coatings from the particles of sand. This abrasive action may be realized through the action of some sort of mechanical member, or through the use of a so-called "air scrubber". The latter refers to a type of device wherein the sand particles are accelerated to relatively high velocities by means of compressed air such that a rubbing action is caused to occur between individual particles of sand. In other instances, the sand particles after being accelerated are made to impinge against a suitably selected surface such that as a result of this impingement the coating fractures and separates from the individual sand particle. For purposes of illustration of a mechanical unit which has been proposed in the prior art for use in connection with the reclamation of foundry sand, reference may be had to U.S. Pat. No. 4,283,015 that issued on Aug. 11, 1981. This patent depicts an apparatus which is intended to be employed for purposes of removing no-bake coatings from foundry sand.

A second category into which such apparatus may be placed, and the one into which the system of the present invention falls, is that of thermal units. In accord therewith, heat is employed for purposes of accomplishing the removal of organic coatings from the sand particles. By way of exemplification in this regard, there has previously been issued on Aug. 22, 1972 to the Applicant of the present invention U.S. Pat. No. 3,685,165. The latter patent is directed in particular to an apparatus for thermally reclaiming resin coated sand. More recently, U.S. Pat. No. 4,429,642 was issued on Feb. 7, 1984 to the Applicant of the present invention directed to another form of thermal reclaimer apparatus. In accord with the teachings of this latter issued patent, there is provided an apparatus embodying rotatable chamber means in which the foundry sand that is to be reclaimed is heated to a predetermined temperature for a preestablished period in order to accomplish the burning away of the organic matter that the used foundry sand contains. Yet still another form of thermal reclaimer apparatus can be found described and illustrated in U.S. patent application Ser. No. 521,495 which was filed on Aug. 8, 1983 in the name of the Applicant of the present invention. In this latter pending patent application there is disclosed a sand reclamation system embodying a thermal reclaimer means which in turn consists of a pipe reclaimer apparatus that has cooperatively associated therewith an air blower and a burner. The air blower and burner are operative to generate a sufficient amount of high temperature gas to effect the transport of the used foundry sand through the pipe reclaimer apparatus at a predetermined velocity. In the course of being conveyed through the pipe reclaimer apparatus organic matter contained in the used foundry sand is burned away.

It is deemed important to make mention here of the fact that the impression should not be had that in order for one to provide a system for effecting the reclamation of used foundry sand, there is a need to be concerned only with the matter of removing organic coatings from sand particles. For, depending upon the condition of the foundry sand that it is desired to reclaim, which in turn is a function of the manner in which the foundry sand has been used, a number of other considerations may be of equal, if not greater, importance. For example, significant amounts of used foundry sand are produced during foundry operations wherein the used foundry sand is replete with organic matter, metal, dust and fines.

As regards the matter of the thermal reclamation of used foundry sand, and in particular that kind of foundry sand which has organic matter, metal, dust and fines present therein, there are a number of factors to which it is desirable that consideration be given if a thermal foundry sand reclamation system is to be provided that will prove to be viable from a commercial standpoint. More specifically, such a thermal foundry sand reclamation system must be capable of accomplishing the removal of the organic matter from the used foundry sand while at the same time leaving the metal that is also present in the used foundry sand in such a form as to enable it subsequently to be readily removed. Thus, one of the factors that must be taken into account in this regard is that of being able to provide sufficient heat to the used foundry sand so that the organic matter present therein is burned away. However, the operating characteristics of the thermal system must be such that the used foundry sand is not heated excessively, i.e., to such a high temperature that the heat produced is sufficient to effect a change in the state of the metal which is present in the used foundry sand. To this end, such a thermal system for reclaiming used foundry sand must possess the capability of enabling the organic matter to be burned away, while at the same time this is being accomplished ensuring that the metal, be it of a ferrous or nonferrous nature, which the used foundry sand contains, is not adversely affected, i.e., rendered more difficult to remove, as a consequence of being exposed to the heat that is employed to burn away the organic matter. In this regard, note is taken here of the fact that some nonferrous metals, e.g., aluminum and zinc, have a significantly different melting temperature than do ferrous metals, and consequently must be treated differently from a temperature standpoint.

Another factor which must be borne in mind when one attempts to provide such a thermal system for reclaiming used foundry sand which contains organic matter, metal, dust and fines is that of the nature of the treatment which should be accorded to the fumes that are generated as the organic matter is being burned away. There are two aspects to this. The first is that of ensuring that such fumes do not pose a danger to the personnel who are attending to the operation of the thermal foundry sand reclamation system. The second is that of ensuring that any fumes which may be exhausted to the atmosphere do not constitute a source of pollutants. That is, the fumes which are exhausted to the atmosphere as a consequence of the operation of such a thermal system for reclaiming used foundry sand should not violate the regulations applicable thereto as established by the local, state and federal authorities having cognizance thereover. The third factor to which it is essential that consideration be given in providing such a thermal foundry sand reclamation system is the matter of the cost thereof. Namely, both in terms of originally providing the system and in terms of operating the system thereafter, the expenditures required thereby must be such as to render it desirable to undertake the requisite investment as compared to continuing the expenditure of the funds necessary to acquire new, i.e., virgin, foundry sand rather than reclaimed foundry sand.

Related to this matter of cost, which is addressed in the preceding paragraph, is the matter of the production output of reclaimed foundry sand that can be realized through the use of such a thermal foundry sand reclamation system. Reference is had here to the fact that for such a thermal foundry sand reclamation system to be commercially viable, it is necessary that the system embody the capability of providing reclaimed foundry sand in the desired quantities, i.e., in amounts sufficient to meet the need therefor as it exists at any given site at which foundry operations capable of making use thereof take place.

The salient point which the preceding discussion serves to make is the fact that there already has been shown to exist in the prior art a need for a system which is operative to effect the reclamation of used foundry sand. In particular, the previous discussion evidences a need in the prior art for a system that is operative to reclaim used foundry sand which contains metal of either a ferrous or nonferrous nature, organic matter, dust and fines. Furthermore, one of the principal components that any such system for reclaiming used foundry sand includes is the apparatus by means of which the organic matter that the used foundry sand contains is thermally removed therefrom; namely, a thermal reclaimer apparatus.

In summary, a need has been demonstrated in the prior art for a thermal sand reclamation system which embodies a new and improved form of thermal reclaimer apparatus that is suitable for use for purposes of effecting the thermal removal of organic matter from used foundry sand. Some of the other characteristics which it would be desirable for such a new and improved thermal reclaimer apparatus to embody would be that of enabling significant energy savings to be realized therewith as well as that of enabling the elimination to be had therewith of some of the components that have heretofore been deemed to be essential for the successful operation of prior art forms of thermal reclaimer apparatus. Lastly, it would also be desirable to provide a new and improved form of feeder means embodying a construction which would render it operative for purposes of feeding granular material into a pipe-like member in a dispersed manner as well as suitable for purposes of being cooperatively associated with the aforesaid new and improved thermal reclaimer apparatus in the aforereferenced thermal sand reclamation system.

It is, therefore, an object of the present invention to provide a system for treating solid, granular and aggregate material which embodies therein reclaimer means for effecting the thermal removal of matter from the material.

It is another object of the present invention to provide a new and improved form of thermal reclaimer means which comprises a first portion of a unitary structure that in turn constitutes one of the operating components of a system for treating solid, granular and aggregate material to effect the thermal removal of matter therefrom.

It is still another object of the present invention to provide a new and improved form of heat exchanger means which comprises a second portion of which a thermal reclaimer means forms the first portion of a unitary structure that in turn constitutes one of the operating components of a system for treating solid, granular and aggregate material to effect the thermal removal of matter therefrom.

A further object of the present invention is to provide a new and improved combination thermal reclaimer and sand-to-sand heat exchanger apparatus which is particularly suited for employment in a system for treating solid, granular and aggregate material to effect the thermal removal of matter therefrom.

A still further object of the present invention is to provide a system embodying a new and improved combination thermal reclaimer and sand-to-sand heat exchanger apparatus, which is characterized in that significant energy savings are capable of being realized therewith and in that the elimination can be had therewith of some of the components that have heretofore been deemed to be essential for the successful operation of prior art forms of thermal reclamation systems.

Yet a further object of the present invention is to provide a system for treating solid, granular and aggregate material to effect the thermal removal of matter from the material which embodies a new and improved form of feeder means operative for feeding material in a dispersed manner into a receiving means.

Yet another object of the present invention is to provide a system for treating solid, granular and aggregate material to effect the thermal removal of matter from material which embodies a new and improved combination thermal reclaimer and sand-to-sand heat exchanger apparatus and a new and improved feeder means, and which is characterized in the fact that it is easy to employ, is reliable in operation, yet is relatively inexpensive to provide.

SUMMARY OF THE INVENTION

In accordance with the present invention there is provided a system for effecting the treatment of solid, granular and aggregate material by thermal means. The subject system, which is particularly suited for use for thermally reclaiming used foundry sand of the kind that contains organic matter, metal, dust and fines, embodies a new and improved combination thermal reclaimer and sand-to-sand heat exchanger apparatus, and a new and improved feeder means. The new and improved combination thermal reclaimer and sand-to-sand heat exchanger apparatus comprises a multi-chamber rotating unit in which incoming unreclaimed sand undergoes a number of processing steps including that of being preheated utilizing the hot outgoing reclaimed sand and hot flue gases. This multi-chamber rotating unit is tightly secured at one end and is free to expand at the opposite end. Further, all external zones of the multi-chamber rotating unit that are exposed to high temperatures, are insulated thereby keeping heat loss to a minimum such that during the operation thereof the external surface of the entire multi-chamber rotating unit is characterized as being relatively cool.

Continuing, in accord with the mode of operation of the subject system, unreclaimed sand is automatically fed into an outer preheat sand chamber of the multi-chamber rotating unit. More specifically, by means of a suitably provided center scoop, a fixed amount of sand is picked up per revolution of the multi-chamber rotating unit and is fed by the center scoop into the outer preheat sand chamber in such a manner as to ensure that a proper seal is maintained at all times thereby to prevent fumes and odors from escaping from the aforesaid chamber while the unreclaimed sand is being fed thereinto. After the unreclaimed sand is fed into the outer preheat chamber, a series of flights serve to move the unreclaimed sand therethrough by lifting and cascading the unreclaimed sand over the inner wall of the outer preheat chamber such that the temperature of the unreclaimed sand gradually increases as a consequence of a direct heat exchange between the unreclaimed sand flowing in a first direction on one side of the aforedescribed inner wall and hot sand flowing in a second direction on the other side of the aforedescribed inner wall. Upon being preheated in the aforesaid manner, the unreclaimed sand is fed from the outer preheat chamber into an inner thermal tube with which the subject combination thermal reclaimer and sand-to-sand heat exchanger apparatus is suitably provided. The sand is heated to a predetermined elevated temperature by heating means with which the aforementioned inner thermal tube is suitably equipped. Here also, a series of flights function to lift and cascade the sand over the hot wall of the inner thermal tube as the sand moves therethrough, i.e., through this hot zone during which the sand is being subjected to thermal reclamation. From the inner thermal tube, the hot sand is fed into a first center chamber of the combination thermal reclaimer and sand-to-sand heat exchanger apparatus such that the sand is caused to flow in a direction opposite to the direction of flow thereof through the inner thermal tube. The reclamation process continues as the hot sand is lifted and cascaded by flights over the hot surface which comprises the wall that exists between the inner thermal tube and the first center chamber. Upon passing through the first center chamber, the hot sand is fed into a second center chamber. The latter second center chamber is insulated from the first center chamber, and as the hot sand flows therethrough it flows in an opposite direction from the direction of flow thereof through the first center chamber towards an exit through which the reclaimed sand is made to leave the combination thermal reclaimer and sand-to-sand heat exchanger apparatus. Flights lift and cascade the hot sand as it flows through the second center chamber over the wall that exists between the second center chamber and the outer preheat chamber such that a direct heat exchange occurs through this wall whereby a cooling of the hot reclaimed sand and a heating of the unreclaimed sand takes place. All the hot gases generated in the combination thermal reclaimer and sand-to-sand heat exchanger apparatus flow through the sand, which is present in the latter apparatus, thereby assuring total oxidation of all the fumes and odor as well as contributing to the preheating of the unreclaimed sand.

The sand which is reclaimed in the combination thermal reclaimer and sand-to-sand heat exchanger apparatus is discharged therefrom onto a screen deck whereat all metal and foreign particulate matter are separated from the sand. From this screen deck, the sand is fed by means of the subject new and improved feeder means into a cooling means, which the subject system also embodies, and wherein the sand is cooled to substantially ambient temperature and is conveyed to a sand storage area. The subject new and improved feeder means comprises a fluidized feeder which is automatically self-regulating. In accord with the mode of operation of the aforereferenced fluidized feeder, as the sand is fed into the cooling means, there are a series of slotted angle baffle plates which allow thin layers of sand to enter the main air stream of the cooling means in the direction of airflow therethrough. The sand is transported through the cooling means as a consequence of the combined action of an air blower and swirler booster, which causes the sand to be moved through the cooling means at a low velocity. All of the grains of sand which enter the cooling means are distributed therein in a spiraling motion as they are caused to flow through the entire length of the cooling and transporting means. The spiraling flow of the sand through the length of the cooling means assures that all sand grains are exposed to the water-cooled wall surface of the cooling means with the result that the temperature of the sand is reduced to substantially ambient temperature.

DESCRIPTION OF A PREFERRED EMBODIMENT

Figure 1:
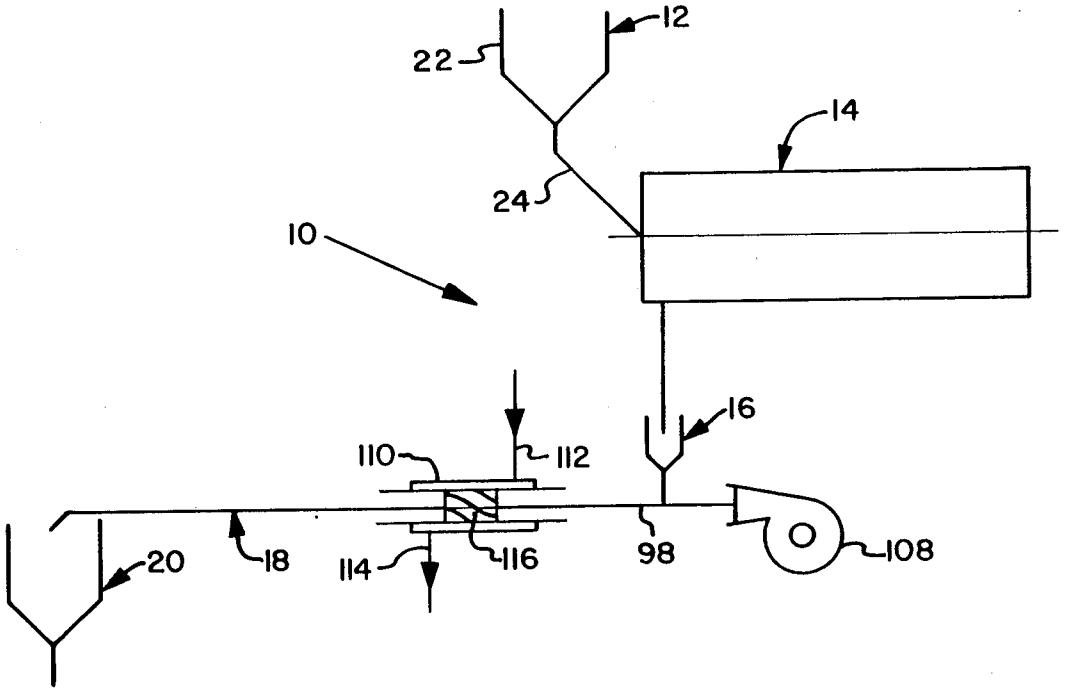
FIG. 1 is a schematic diagram of a system for effecting the treatment of solid, granular and aggregate material by thermal means, constructed in accordance with the present invention.

Referring now to the drawing and more particularly to FIG. 1 thereof, there is depicted therein a system for effecting the treatment by thermal means of solid, granular and aggregate material, generally designated by reference numeral 10, constructed in accordance with the present invention. The system 10 is primarily designed to be utilized for purposes of effecting the thermal reclamation of used foundry sand, and in particular used foundry sand of the kind which contains organic matter, metal of either a ferrous or nonferrous nature, dust and fines. As best understood with reference to FIG. 1, the system 10 includes a multiplicity of components that are suitably arranged so as to be cooperatively associated in series relation one with another. More specifically, in accord with the illustration thereof in FIG. 1, the major components of the system 10 comprise the following: unreclaimed sand supply means, generally designated by reference numeral 12; combination thermal reclaimer and sand-to-sand heat exchanger means, generally designated by reference numeral 14; feeder means, generally designated by reference numeral 16; cooling and transporting means, generally designated by reference numeral 18; and reclaimed sand storage means, generally designated by reference numeral 20.

Continuing with the description of the system 10, the unreclaimed sand supply means 12, preferably and in accord with the illustration thereof in the drawing encompasses a sand storage silo, the latter being schematically depicted in FIG. 1 at 22. The storage silo 22, which may comprise any form of silo of conventional construction suitable for use for this purpose is appropriately supplied with material that is designed to be thermally treated in the system 10. For purposes of the description that follows, this material will be assumed to be spent, i.e., used, chemically bonded foundry sand, lumps, metal and fines. Moreover, the particles of used foundry sand, which are stored in the sand storage silo 22, desirably have a dimension of minus three-quarter inch and are normally at ambient temperature. Although for purposes of the description that follows the subject matter is deemed to be used foundry sand, it is to be understood that the system 10 could equally well be employed for purposes of effecting the treatment by thermal means of other types of solid, granular and aggregate material. The sand storage silo 22 may, if desired, be suitably provided in known fashion with a conventional form of metering means (not shown). More specifically, such a metering means (not shown) may be cooperatively associated with the outlet of the sand storage silo 22 such as to be operative for controlling the flow of material from the sand storage silo 22. Further, the metering means (not shown) in turn may be made to operate through the use of any suitable form of means (not shown) such that the material, e.g., used foundry sand, is caused to feed from the sand storage silo 22 at a controlled rate.

From the sand storage silo 22 the used foundry sand, as schematically depicted at 24 in FIG. 1, is conveyed by any suitable form of conveying means of a conventional nature to the combination thermal reclaimer and sand-to-sand heat exchanger means 14. As will be described more fully hereinafter, the combination thermal reclaimer and sand-to-sand heat exchanger means 14 performs a two-fold function. Namely, on the one hand the combination thermal reclaimer and sand-to-sand heat exchanger means 14 is operative to effect a preheating of the used foundry sand as the latter travels therethrough. More specifically, the intent here is to effectuate a preheating of the used foundry sand, which in its stored state in the sand storage silo 22 is at essentially ambient temperature, to a temperature approximating 800° F. when the used foundry sand now preheated leaves the sand-to-sand heat exchanger portion of the combination thermal reclaimer and sand-to-sand heat exchanger means 14. On the other hand, the combination thermal reclaimer and sand-to-sand heat exchanger means 14 also is operative to accomplish a thermal reclamation of the used foundry sand as the latter travels therethrough whereby the organic matter that is contained in the used foundry sand is caused to be burned away.

Figure 2:
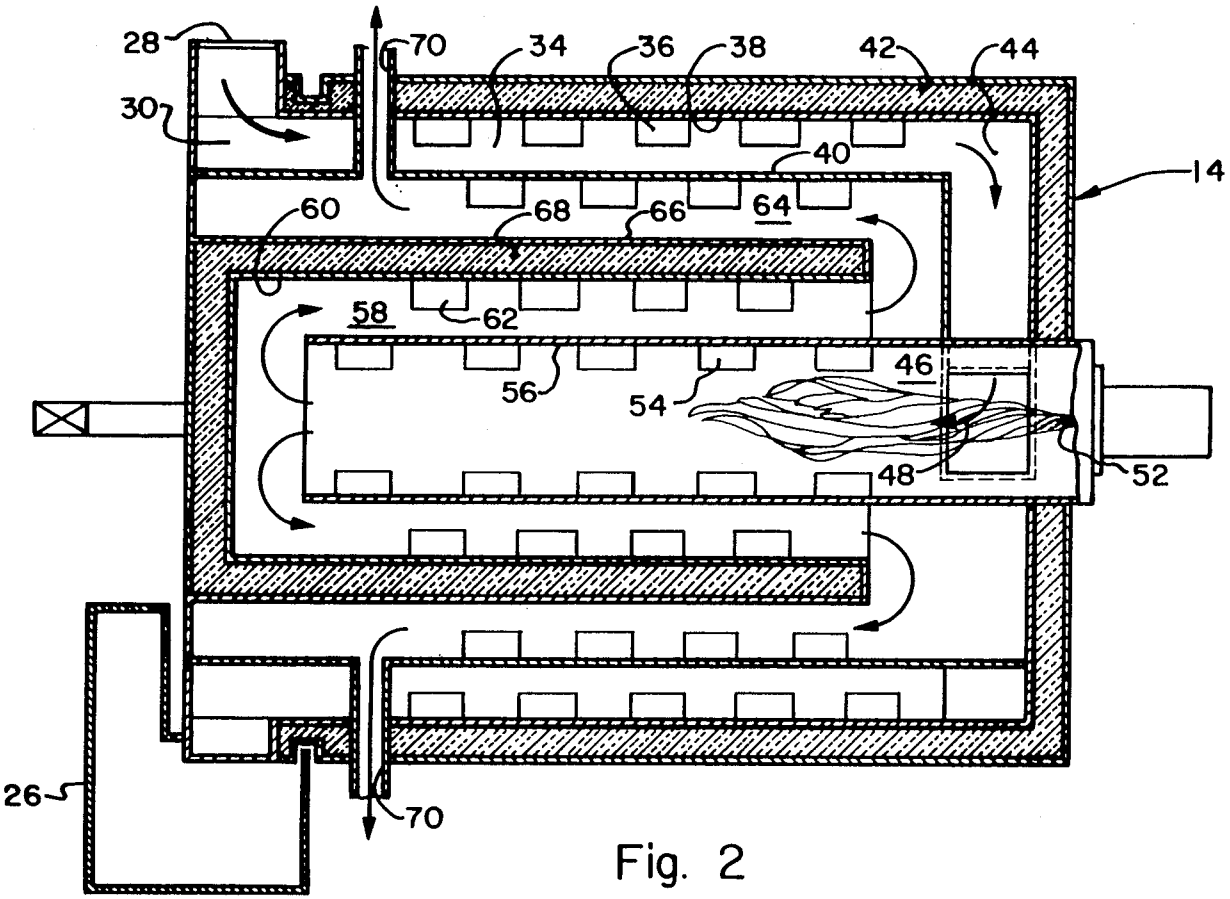
FIG. 2 is a side elevational view in section, of a combination thermal reclaimer and sand-to-sand heat exchanger apparatus that is suitable for use in the system of FIG. 1, constructed in accordance with the present invention.
Figure 3:
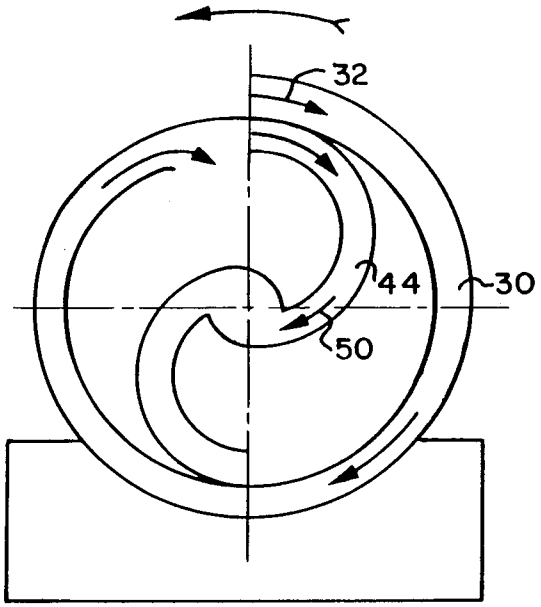
FIG. 3 is a schematic diagram of the path of flow of material through the combination thermal reclaimer and sand-to-sand heat exchanger apparatus of FIG. 2, constructed in accordance with the present invention.
Figure 2A:
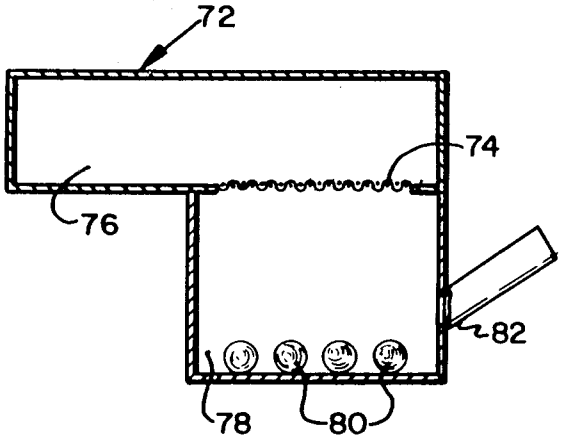
FIG. 2A is a schematic diagram of a screen deck which is suitable for being cooperatively associated with the combination thermal reclaimer and sand-to-sand heat exchanger apparatus of FIG. 2, constructed in accordance with the present invention.

A description will now be had of the nature of the construction as well as the mode of operation of the combination thermal reclaimer and sand-to-sand heat exchanger means 14, which constitutes one of the operating components of the system 10, the latter being schematically depicted in FIG. 1 of the drawing. For this purpose, reference will be had in particular to FIGS. 2, 2A and 3 of the drawing. The combination thermal reclaimer and sand-to-sand heat exchanger means 14, as depicted in FIG. 2, comprises a multi-chamber unit, which as will be described more fully hereinafter is designed to be rotatable. Further, in accord with the best mode embodiment of the invention, the multi-chamber rotating unit 14 preferably is cylindrical in configuration.

Continuing, as best understood with reference to FIG. 2, the multi-chamber rotating unit 14 preferably has cooperatively associated therewith in any suitable conventional manner a receiver bin, the latter being denoted by the reference numeral 26 in FIG. 2 of the drawing. The receiver bin 26 is intended to function in the manner of a temporary storage bin for the used foundry sand that is being fed to the multi-chamber rotating unit 14 from the sand storage silo 22. More specifically, the receiver bin 26 receives used foundry sand from the sand storage silo 22 by means of the conveying means 24 at such a rate as to keep the receiver bin 26 substantially full of used foundry sand at all times.

In accord with the best mode embodiment of the present invention, the used foundry sand is removed from the receiver bin 26 in the following manner. At one end thereof the multi-chamber rotating unit 14 has formed thereon such as to project outwardly therefrom a predetermined distance a scoop-like member, the latter being seen at 28 in FIG. 2 of the drawing. With the multi-chamber rotating unit 14 and the receiver bin 26 bearing the relationship one to another illustrated in FIG. 2, the scoop-like member 28 periodically is made to occupy a position located in juxtaposed relation to the receiver bin 26. More specifically, as the scoop-like member 28 rotates into juxtaposed relation with the receiver bin 26 during each revolution of the multi-chamber rotating unit 14, the scoop-like member 28 is operative to remove a fixed amount of used foundry sand from the receiver bin 26.

The scoop-like member 28 in turn communicates with a tube 30 with which the multi-chamber rotating unit 14 is suitably provided at one end thereof, i.e., the left end thereof as seen with reference to FIG. 2 of the drawing. As the multi-chamber rotating unit 14 continues to rotate, the used foundry sand which has been scooped up out of the receiver bin 26 by the scoop-like member 28 slides in the tube 30 under the influence of the rotational motion of the multi-chamber rotating unit 14. For purposes of better understanding the nature of the path of travel which the used foundry sand follows within the tube 30 after leaving the scoop-like member 28, reference may be had to FIG. 3 of the drawing. Thus, as seen with reference to the latter figure the used foundry sand after entering the tube 30, a schematic representation of which can be seen in FIG. 3 at 30, slides therethrough in accord with the path of flow depicted in FIG. 3 by the series of arrows that are identified therein by the reference numeral 32.

After approximately 350° of rotation within the tube 30, the unreclaimed used foundry sand discharges from the tube 30 into a first chamber 34, more aptly referred to hereinafter as the outer preheat sand chamber, with which the tube 30 is cooperatively associated in fluid flow relation in a suitable manner such as to enable the aforedescribed discharge to take place. Virtually simultaneously a new load of unreclaimed used foundry sand is being scooped up from the receiver bin 26 by the scoop-like member 28 as the latter once again passes into juxtaposed relation with the former. The effect thereof is that a certain amount of unreclaimed used foundry sand is present within the tube 30 at all times. Consequently, a sand seal is continuously established between the outer preheat sand chamber 34 and the exterior of the multi-chamber rotating unit 14 by virtue of the presence of this sand in the tube 30. Continuing, the effect of this sand seal is to prevent fumes and odors from escaping from the outer preheat sand chamber 34 through the tube 30 and the scoop-like member 28 to the outside of the multi-chamber rotating unit 14. As the multi-chamber rotating unit 14 continues to rotate, the unreclaimed used foundry sand which has entered the outer preheat sand chamber 34 from the tube 30 completes a traverse of the outer preheat sand chamber 34 from the left end thereof to the right end thereof, as viewed with reference to FIG. 2 of the drawing. To this end, in accord with the best mode embodiment of the invention, a plurality of suitably dimensioned members 36, hereinafter referred to as flights, are suitably provided, through the use of any conventional means suitable for use for this purpose, on the outer wall surface 38 of the outer preheat sand chamber 34 such as to be located in suitably spaced relation one to another therealong. As the unreclaimed used foundry sand moves from left to right, as viewed with reference to FIG. 2 of the drawing, through the outer preheat sand chamber 34 the flights 36 operate to cause the unreclaimed used foundry sand to be picked up and cascaded down into engagement with the hot inner wall surface 40 of the outer preheat sand chamber 34. In a manner to be more fully described hereinafter, the effect of the unreclaimed used foundry sand being made to engage the hot inner wall surface 40 of the outer preheat sand chamber 34 is to cause a heat transfer to occur therebetween whereby a preheating of the unreclaimed used foundry sand takes place as the latter completes a traverse of the outer preheat sand chamber 34. More specifically, as the unreclaimed used foundry sand travels the length of the outer preheat sand chamber 34, the sand picks up heat from the hot inner wall surface 40 of the outer preheat sand chamber 34 and gradually gets heated to a temperature typically approximating 800° F. As a further note here, mention is made of the fact that the outer wall surface 38 of the outer preheat sand chamber 34 is well insulated through the use of a conventional form of insulation means, the latter being seen at 42 in FIG. 2, which is selected on the basis of its suitability for use for this purpose.

When the now preheated unreclaimed used foundry sand reaches the right end, as viewed with reference to FIG. 2 of the drawing, of the outer preheat sand chamber 34, the sand gets picked up by a transfer channel, the latter being denoted by the reference numeral 44 in FIG. 2, with which the multi-chamber rotating unit 14 is suitably provided. After being picked up by the transfer channel 44, the preheated unreclaimed used foundry sand is transported thereby to the inner tube 46 and is deposited therewithin. The path followed by the preheated unreclaimed used foundry sand in traveling from the outer preheat sand chamber 34 to the transfer channel 44 and from the transfer channel 44 to the inner tube 46 is identified by the line appearing in FIG. 2 which has cooperatively associated therewith the arrow that is denoted in FIG. 2 by the reference numeral 48. For purposes of better understanding the nature of the path of travel which the preheated unreclaimed used foundry sand follows within the transfer channel 44 after being picked up thereby from the outer preheat sand chamber 34, reference may be had to FIG. 3 of the drawing. In this regard, as best understood with reference to FIG. 3, the preheated unreclaimed used foundry sand after entering the transfer channel 44, a schematic representation of which is seen at 44 in FIG. 3, slides therethrough in accord with the path of travel that the arrows designated by the reference numeral 50 in FIG. 3 serve to identify. Note is also taken here of the fact that in addition to the preheated unreclaimed used foundry sand which passes through the transfer channel 44 from the outer preheat sand chamber 34 to the inner tube 46, the fumes and odors that are generated in the outer preheat sand chamber 34 in the course of the passage therethrough of the unreclaimed used foundry sand are likewise transported by means of the transfer channel 44 from the outer preheat sand chamber 34 to the inner tube 46.

Continuing, the inner tube 46, at the right end thereof, as viewed with reference to FIG. 2 of the drawing is suitably provided through the use of any form of conventional means, with a burner, the latter being identified generally in FIG. 2 by the reference numeral 52. The burner 52 is suitably sized, as will be mentioned again hereinafter, such that sufficient heat is generated thereby to cause the unreclaimed used foundry sand, which has been preheated in the outer preheat sand chamber 34 to a temperature approximating 800° F., to now be heated to a temperature approximating 1500° F. as this sand travels through the inner tube 46 from the right end thereof to the left end thereof as viewed with reference to FIG. 2.

As in the case of the outer preheat sand chamber 34, the inner tube 46 is also provided with a plurality of suitably dimensioned members 54, hereinafter referred to as flights. The flights 54 are suitably located on the outer wall surfaces of the inner tube 46 through the employment of any form of conventional means suitable for use for this purpose such that the flights 54 are located in suitably spaced relation one to another therealong. Further, the flights 54 are operative, as the multichamber rotating unit 14 is rotating, to cause the used foundry sand that enters at the right end of the inner tube 46 to move therethrough from right to left as viewed with reference to FIG. 2. Moreover, as the used foundry sand is moving through the inner tube 46 in the aforedescribed manner the sand is picked up by the flights 54 and in cascading fashion then falls under the influence of gravity into contact with the wall surfaces 56 of the inner tube 46. As this picking up and cascading of the used foundry sand is taking place, the used foundry sand under the influence of the heat being produced by the burner 52 is being heated to a temperature approximating 1500° F. The latter temperature is sufficient to effectuate a burning away of organic matter which is present in the used foundry sand. Namely, as the used foundry sand is made to travel through the inner tube 46, the former is being subjected to the process of thermal reclamation. However, as will be discussed more fully hereinafter, the entire process of thermal reclamation of the used foundry sand is not completed within the inner tube 46.

Upon reaching the left end as viewed with reference to FIG. 2, of the inner tube 46, the used foundry sand which has been subjected to a thermal reclamation action within the inner tube 46 passes into a first central chamber, the latter being denoted by the reference numeral 58 in FIG. 2. As can be seen with reference to FIG. 2, the outer wall surfaces 60 of the first central chamber 58 are suitably provided with a plurality of suitably dimensioned members 62, the latter being hereinafter referred to as flights. The flights 62 are mounted on the outer wall surfaces 60 of the first central chamber 58 through the use of any form of conventional means suitable for utilization for this purpose such that the flights 62 are suitably spaced one from another along the outer wall surfaces 60. The flights 62 are operative, in a manner similar to that previously described hereinbefore in connection with the discussion of the flights 36 and the flights 54, to cause the used foundry sand to be transported through the first central chamber 58 as the multi-chamber rotating unit 14 is rotating. More specifically, the flights 62 are operative to cause the used foundry sand as it moves through the first central chamber 58, from the left end thereof to the right end thereof as viewed with reference to FIG. 2 of the drawing, to be lifted up and cascaded down into engagement with the outside wall surfaces 56 of the inner tube 46. During the course of its passage through the first central chamber 58, the used foundry sand becomes fully reclaimed and all of the organic fumes generated during the thermal reclamation process are combusted. To this end, in order to complete the process of the thermal reclamation of the used foundry sand, it is necessary that the latter be subjected to a predetermined temperature for a preestablished period of time. As a consequence of being preheated within the outer preheat sand chamber 34 and of being subjected to the heat produced by the burner 52 the used foundry sand that is sought to be reclaimed is elevated to the aforereferenced predetermined temperature. Further, by causing the heated used foundry sand to travel the length of the inner tube 46 and that of the first central chamber 58 the used foundry sand sought to be reclaimed is caused to be subjected to the aforereferenced predetermined temperature for the aforereferenced preestablished period of time; namely, passage through the inner tube 46 and the first central chamber 58 provides the used foundry sand with the requisite amount of residence time at the aforereferenced predetermined temperature to accomplish the desired thermal reclamation thereof.

On reaching the right end, as viewed with reference to FIG. 2, of the first central chamber 58, the new reclaimed sand is discharged therefrom, i.e., falls into the second central chamber, the latter being denoted by the reference numeral 64 in FIG. 2 of the drawing. Note is taken at this point of the fact that both the outer wall surfaces 60 of the first central chamber 58 and the inner wall surfaces 66 of the second central chamber 64 are suitably insulated, as seen at 68 in FIG. 2, by means of any form of conventional insulating means that is suitable for use for this purpose. As the multichamber rotating unit 14 rotates, the new reclaimed sand is made to traverse substantially the length of the second central chamber 64 from the right end thereof to the left end thereof as viewed with reference to FIG. 2 of the drawing.

The movement of the new reclaimed sand through the second central chamber 64 is effected through the combined action of the rotation of the multi-chamber rotating unit 14 and the plurality of suitably dimensioned members 70, hereinafter referred to as flights. More specifically, the flights 70 are operative to pick up the new reclaimed sand and to cascade it down against the uninsulated wall surface 40 which functions in the manner of a counterflow heat transfer barrier between the outer preheat sand chamber 34 and the second central chamber 64. By virtue of the contact which occurs between the new reclaimed sand moving through the second central chamber 64 as well as the heat generated by the hot gases from the combustion process that takes place within the multi-chamber rotating unit 14 the wall surface 40 becomes heated. Moreover, as has been described previously herein the effect of contact occurring between the unreclaimed used foundry sand as it traverses the length of the outer preheat sand chamber 34 and the hot wall surface 40 is that the unreclaimed used foundry sand in the outer preheat sand chamber 34 becomes preheated from a temperature approximating ambient temperature to a temperature typically approximating 800° F.

After traversing the length of the second central chamber 64, i.e., upon reaching the left end thereof as viewed with reference to FIG. 2 of the drawing, the new reclaimed sand as well as the flue gas generated during combustion are next discharged therefrom. More specifically, not only are the new reclaimed sand and the flue gas discharged from the second central chamber 64, but concomitantly therewith they are also discharged from the multi-chamber rotating unit 14. To this end, the multi-chamber rotating unit 14 is suitably provided with pipe means, the latter being denoted in FIG. 2 by reference numeral 70. The latter pipe means 70 can take the form of any conventional means suitable for use for this purpose. Mention is made here of the fact that at the time of discharge from the multi-chamber rotating unit 14 through the pipe means 70 the new reclaimed sand is at a temperature approximating 400° F. From the multi-chamber rotating unit 14 the new reclaimed sand is then transported, as best understood with reference to FIG. 1, to the feeder means 16. Moreover, preferably in the course of being so transported from the multi-chamber rotating unit 14 to the feeder means 16, the new reclaimed sand is screened. To this end, any suitable conventional form of screening means (not shown) may be employed for this purpose. Further, this screening means (not shown) may be emplaced at any suitable location along the path of transport of the new reclaimed sand between the multi-chamber rotating unit 14 and the feeder means 16.

With regard to the subject of screening, if deemed desirable as in applications wherein the sand contains nonferrous metal, a screening may be had of the unreclaimed used foundry sand prior to the passage thereof through the multi-chamber rotating unit 14. More specifically, the multichamber rotating unit 14 may be made to embody a screening chamber for this purpose. Preferably, such a screening chamber would, as best understood with reference to FIG. 2A of the drawing, comprise a separate chamber, the latter being denoted by the reference numeral 72 in FIG. 2A. The latter chamber 72 in turn is subdivided by means of a screen-like member 74, the latter being suitably mounted within the chamber 72 through the use of any conventional form of mounting means (not shown), into a pair of compartments 76 and 78. In one of these compartments, i.e., compartment 78, preferably there are housed a plurality of ceramic balls 80. Completing the description of the chamber 72, the latter is suitably provided with discharge pipe means, the latter being seen at 82 in FIG. 2A. Thus, to summarize, in those instances wherein it is deemed desirable to effectuate the separation of metal from the used foundry sand prior to subjecting the latter to the thermal reclamation process in the multi-chamber rotating unit 14, the separate chamber 72 of FIG. 2A may be cooperatively associated preferably with the outer preheat sand chamber 34 in a suitable manner such that the unreclaimed preheated used foundry sand is made to pass through the chamber 72 prior to reaching the inner tube 46. In the course of passing through the chamber 72, the screen-like member 74 is operative to separate the metal from the sand, and the ceramic balls 80 are operative to crush the friable material that may be present in the used foundry sand. Finally, the material which has been separated from the used foundry sand is discharged from the chamber 72 through the discharge pipe means 82, and may thereafter be collected in any suitable form of container.

Summarizing the mode of operation of the multi-chamber rotating unit 14, unreclaimed used foundry sand is automatically fed from the receiver bin 26 into the outer preheat sand chamber 34. That is, the scoop-like member 28 picks up a fixed amount of sand per revolution of the multi-chamber rotating unit 14 and feeds the unreclaimed used foundry sand into the tube 30 from whence this sand is fed into the outer preheat sand chamber 34. This is done in such a manner that there is established within the tube 30 at all times a sand seal that is operative to prevent the escape to the exterior of the multi-chamber rotating unit 14 of fumes and odors from the outer preheat sand chamber 34. After the used foundry sand is fed into the outer preheat sand chamber 34, a series of flights 36 move the unreclaimed sand through the chamber 34 lifting and cascading this sand over the inner wall surface 40 whereby the temperature of this sand is gradually increased through direct heat exchange with the wall surface 40. From the outer preheat sand chamber 34 the used foundry sand is made to flow into the transfer channel 44 and therefrom to the inner tube 46. The latter is equipped with a burner 52, which is capable of heating the used foundry sand to a temperature approximating 1500° F. A series of flights 54 lift and cascade the used foundry sand over the hot wall surface 56 of the inner tube 46, thereby causing this sand to move through the hot zone which exists within the inner tube 46. The hot sand is then fed from the inner tube 46 through the first central chamber 58 wherein the hot sand moves in a direction counter to the direction of movement of the hot sand within the inner tube 46. The reclamation process continues as the hot sand in the course of moving through the first central chamber 58 is lifted and cascaded over the hot wall surface 56 that exists between the inner tube 46 and the first central chamber 58. Next, the hot sand is fed into the second central chamber 64, the latter being insulated by insulating means 68 from the first central chamber 58. Within the second central chamber 64 the hot sand moves in a direction counter to the direction of movement of the hot sand within the first central chamber 58. In effect, therefore, it can be seen that the used foundry sand in moving through the multi-chamber rotating unit 14 follows what might best be described as being in the nature of substantially a serpentine-like path. Continuing, as the hot sand moves through the second central chamber 64, flights 70 lift and cascade the sand into contact with the wall surface 40 that exists between the second central chamber 64 and the outer preheat sand chamber 34 thereby occasioning a cooling of the reclaimed sand moving through the second central chamber 64 and a heating of the unreclaimed used foundry sand moving through the outer preheat sand chamber 34. There is also made mention here of the fact that all the hot gases from the combustion process that takes place within the multi-chamber rotating unit 14 flow through the sand while the latter is in the multichamber rotating unit 14 thereby occasioning the total oxidation of all fumes and odors, as well as further contributing to the preheating of the unreclaimed used foundry sand. After being reclaimed within the multi-chamber rotating unit 14, the sand is discharged from the unit 14 to a screening means (not shown) which in turn is operative to accomplish the separation from the reclaimed sand of foreign particulate matter that may still be present therein. Finally, from the screening means (not shown) the reclaimed sand now free of foreign particulate matter is fed to the feeder means 16, and therefrom to the cooling and transport means, seen at 18 in FIG. 1, which is operative to effectuate a cooling of the reclaimed sand to substantially ambient temperature as the reclaimed sand is being transported thereby to the reclaimed sand storage means 20.

In accord with the best mode embodiment of the invention, the approximate overall dimensions of a unit of the multi-chamber rotating unit 14 having a capacity of one to two tons per hour, in the form illustrated in FIG. 2 of the drawing, are six feet wide by twelve feet high by twenty feet long. Further, the multi-chamber rotating unit 14 preferably is driven by a ten HP helical triple reduction gear motor, and is supported at both ends with spherical self-aligning roller bearings. Moreover, the multi-chamber rotating unit 14 has one end thereof which is tightly secured while the other end is free to expand. All external zones of the multi-chamber rotating unit 14 that are exposed to high temperatures are suitably insulated by insulating means 42, 68 thereby keeping heat loss to a minimum to the point that the entire multichamber rotating unit 14 can be said to operate in a cool manner. The insulating means 68 preferably comprises a commercially available high temperature ceramic wool type product, which is known to be manufactured for use in high temperature applications. The ceramic fibers of this insulating means 68 possess excellent insulation properties and are not subject to deterioration. The burner 52, which preferably takes the form of a gas burner, is designed to deliver 750,000 BTU per hour. In addition, the burner 52 preferably is equipped with automatic electrical ignition (direct spark) ultraviolet safety protection controls designed to satisfy applicable regulations. The inner tube 46 preferably is fabricated of a cast high heat resistant alloy, while the other chambers 34, 58 and 64 with which the multichamber rotating unit 14 is provided are fabricated from stainless steel.

Consideration will now be given to the feeder means 16. For this purpose, reference will be had in particular to FIGS. 4, 5, 6 and 7 of the drawing. Although the feeder means 16 is illustrated in the drawing of the instant application and is described hereinafter from the standpoint of its use as one of the major components of the system 10, it is to be understood that the feeder means 16 is not so limited in its use but rather can find use in many other types of applications.

Figure 5:
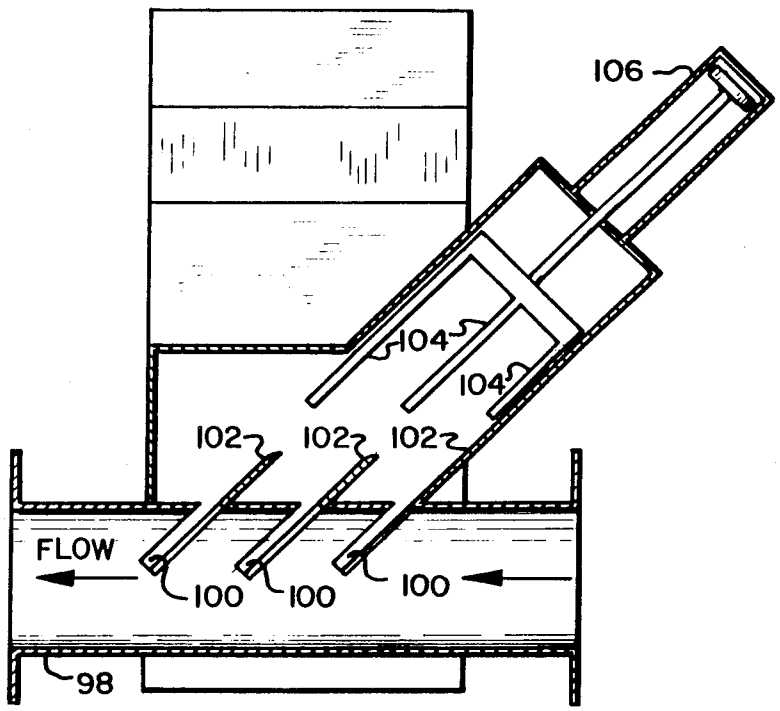
FIG. 5 is a side elevational view, in section, of the fluidized feeder apparatus of FIG. 4, constructed in accordance with the present invention.
Figure 4:
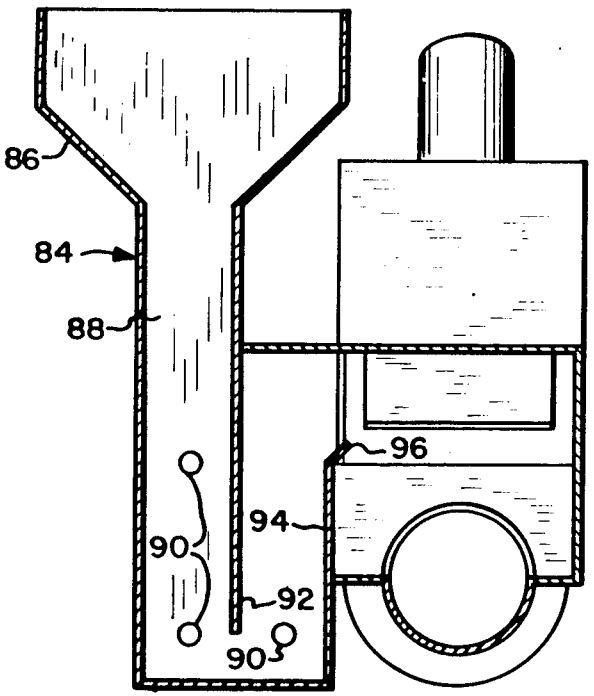
FIG. 4 is an end view, in section, of a fluidized feeder apparatus that is suitable for use in the system of FIG. 1, constructed in accordance with the present invention.
Figure 7:
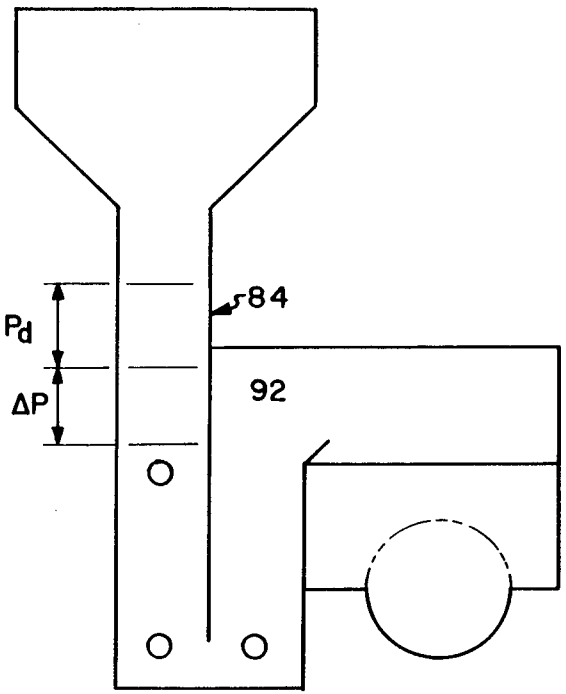
FIG. 7 is a schematic diagram of the fluidized feeder apparatus of FIG. 4, constructed in accordance with the present invention, illustrating the level of material therewithin under a second operating condition.

Proceeding thus with a description of the nature of the construction and the mode of operation of the feeder means 16, the latter as best understood with reference to FIGS. 4 and 5 of the drawing includes a suitably configured housing, the latter being denoted generally in the drawing by reference numeral 84. In accord with the embodiment thereof illustrated in the drawing, the housing 84 includes a mouth-like portion 86 into which the reclaimed sand which leaves the multi-chamber rotating unit 14 through the discharge pipe means 70 is designed to be received. After being received within the mouth-like portion 86 of the housing 84 the reclaimed sand passes into the fluidized bed portion, the latter being identified in FIG. 4 by the reference numeral 88, of the housing 84. The portion 88 bears the designation fluidized bed by virtue of the fact that the sand moving therethrough has in a manner well-known to those skilled in this art a fluidizing action imparted thereto. Namely, a plurality of fluidizing pipes 90 are suitably located within the portion 88 of housing 84 such as to extend substantially in a horizontal plane therewithin, as viewed with reference to FIG. 4 of the drawing. Each of the fluidizing pipes 90 is provided in a manner well-known to those skilled in this art with a multiplicity of suitably dimensioned openings (not shown). Further, each of the fluidizing pipes 90 is suitably connected to a supply of air (not shown) which is at a suitable pressure such that air passes through the fluidizing pipes 90 and exits therefrom through the aforereferenced multiplicity of openings (not shown) with which each of the fluidizing pipes 90 is suitably provided. The air leaving the fluidizing pipes 90 under pressure passes through the reclaimed sand that is present in the portion 88 of the housing 84, and in doing so imparts in a manner well-known to all a fluidizing motion thereto.

Continuing with the description of the nature of the construction of the feeder means 16, the housing 84 further includes a first baffle 92 and a second baffle 94. The first baffle 92, as best understood with reference to FIG. 4 of the drawing, preferably is formed in such a manner as to extend coextensively with one of the side wall members that serve to define the mouth-like portion 86 of the housing 84. Further, the first baffle 92 is suitably dimensioned so as to project within a few inches of the bottom of the fluidized bed portion 88, i.e., so as to extend in spaced relation to the bottom wall surface of the housing 84. The second baffle 94, on the other hand, extends from the bottom wall surface of the housing 84 in an upwardly direction as viewed with reference to FIG. 4, and terminates short of reaching the top wall surface of the housing 84. Moreover, in accord with the illustrated embodiment thereof in FIG. 4, the second baffle 94 terminates at its free end in a portion 96 that forms an acute angle with the plane defined by the second baffle 94. By virtue of the aforedescribed construction of both the first baffle 92 and the second baffle 94, a path of movement is established for the reclaimed sand within the housing 84 whereby in a manner to which further reference will be had hereinafter sand entering the housing 84 through the mouth-like portion 86 thereof is made to pass, as a consequence of the fluidizing action to which it is subjected in moving through the fluidized bed portion 88 of the housing 84, beneath the first baffle 92 and then over the second baffle 94.

The feeder means 16 is designed to be cooperatively associated with some other component such as, by way of exemplification and not limitation, the cooling and transporting means, denoted by the reference numeral 18 in FIG. 1 of the drawing. To this end, in accord with the illustration thereof in FIGS. 4 and 5 of the drawing the housing 84 of the feeder means 16 is cooperatively associated with the transporter pipe 98 of the cooling and transporting means 18. More specifically, the housing 84 of the feeder means 16 and the transporter pipe 98 of the cooling and transporting means 18 are, as best seen with reference to FIG. 5 of the drawing, suitably supported through the use of any conventional form of support means (not shown) in juxtaposed relation one to another. Moreover, the transporter pipe 98 for a purpose yet to be described preferably has formed therein a plurality of suitably dimensioned and configured slots 100. In accord with the illustrated embodiment thereof, the transporter pipe 98 as depicted in FIG. 5 is provided with three such slots 100, the latter being formed in the transporter pipe 98 such as to be located in substantially equally spaced relation one to another, and such as to be inclined at an angle of approximately 45° to the direction of flow in the transporter pipe 98. Continuing, each of the slots 100 has a guide plate 102 cooperatively associated therewith through the use of any form of conventional means (not shown) such that each guide plate 102 projects to a suitable extent into a corresponding one of the slots 100. Completing the description of the nature of the construction of the feeder means 16, the housing 84 thereof for a purpose yet to be described also includes a plurality of cleaning lugs 104, there being one such cleaning lug 104 provided for each of the guide plates 102, and a cleaning cylinder 106 which as will be discussed subsequently is cooperatively associated with the cleaning lugs 104 in such a manner as to be operative when actuated to cause the cleaning lugs 104 to move to and fro relative to the guide plates 102.

Turning now to a consideration of the mode of operation of the feeder means 16, sand enters the mouth-like portion 86 of the housing 84 and is subjected to a fluidizing action caused by air under pressure exiting from the fluidizing pipes 90 as the sand passes through the fluidized bed portion 88 of the housing 84. As a consequence of this fluidizing action the sand is then caused to move beneath the first baffle 92 and over the second baffle 94 whereupon the sand enters the transporter pipe 98 through the slots 100 with which the latter is provided for this purpose. The sand is guided to and into the slots 100 by the guide plates 102. A further function performed by the guide plates 102 is that they serve to break up the energy of the sand stream flowing into the transporter pipe 98 by causing the sand stream as it reaches the transporter pipe 98 to be divided up into thin sheets of sand for purposes of entering the transporter pipe 98 through the slots 100 formed therein. At regular intervals, in accord with the preferred mode of operation of the feeder means 16, the cleaning cylinder 106 is actuated through the action of any suitable means (not shown) such that the cleaning lugs 104 are moved to and fro relative to the guide plates 102 and into the slots 100 thereby through the action thereof to cause the dislodgment of any sand that might otherwise tend to build up in the slots 100 and thus occasion a clogging of the slots 100.

Figure 6:
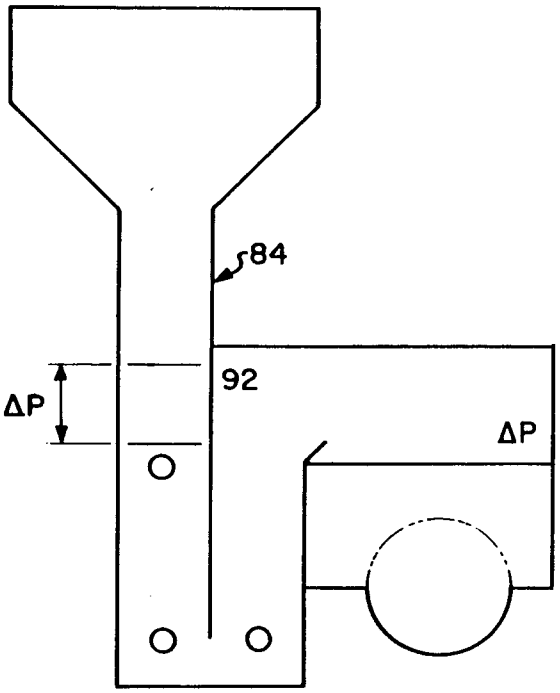
FIG. 6 is a schematic diagram of the fluidized feeder apparatus of FIG. 4, constructed in accordance with the present invention, illustrating the level of material therewithin under a first operating condition.

As best understood with reference to FIGS. 4 and 5 of the drawing, when there is no pressure in the transporter pipe 98, the level of the sand in the housing 84 will be the same on each side of the first baffle 92. However, when the pressure inside the transporter pipe 98 differs from atmospheric pressure by an amount equal to $\Delta P$, the level of the sand of the housing 84 adjusts itself to accommodate this difference. This is the condition which is depicted in FIG. 6 of the drawing. On the other hand, when the granular material, i.e., sand, is supplied to the feeder means 16 at a fixed rate, the level of the sand on the supply side of the first baffle 92 adjusts itself to accommodate both $\Delta P$ and $P_d$, where $P_d$ is the pressure drop for the sand flowing through the housing 84 at the fixed rate. This is the condition depicted in FIG. 7 of the drawing.

With reference to FIG. 1 of the drawing, the cooling and transporting means 18 will now be described. However, before proceeding with this description, it should be once again be noted that the reclaimed sand, upon leaving the combination thermal reclaimer and sand-to-sand heat exchanger means 14, is at a temperature approximating 400° F. Continuing, the cooling and transporting means 18 embodies the previously mentioned transporter pipe 98. Regarding the dimensions of the transporter pipe 98, the diameter thereof is determined primarily based on the amount of reclaimed sand that is desired to pass therethrough. Likewise, the length of the transporter pipe 98 is determined primarily based on the amount of cooling of the reclaimed sand that it is desired to have take place as the reclaimed sand travels the length of the transporter pipe 98. As depicted in FIG. 1, the transporter pipe 98 embodies a straight length, however, other configurations could equally well be used, if so desired, without departing from the essence of the present invention.

The transporter pipe 98 has one end thereof connected to an air blower 108, at a point upstream of the location whereat the reclaimed sand enters the transporter pipe 98 from the feeder means 16. Insofar as the air blower 108 is concerned, any type of air blower of conventional construction and appropriate for use in the manner set forth hereinafter may be so employed. The air blower 108 is operative for purposes of generating sufficient airflow to effect the transport through the transporter pipe 98 of the grain size reclaimed sand particles at a preestablished velocity. The velocity at which the reclaimed sand particles travel through the transporter pipe 98 is selected so as to be such that sand particles will be carried along in the airflow through the transporter pipe 98. That is, the velocity of the sand particles must be such as to cause the sand particles to travel to the end of the transporter pipe 98 and not drop out of the air stream intermediate the ends of the transporter pipe 98, whereupon a build up of sand particles could occur in the transporter pipe 98 which would impede the cooling operation that it is intended to have take place within the transporter pipe 98.

The transporter pipe 98 can be fabricated from any suitable material capable of accommodating the temperature at which the reclaimed sand is at when entering the transporting pipe 98, e.g., 800° F. For purposes of effecting the cooling of the reclaimed sand in the transporter pipe 98, the latter is preferably encased within a water jacket 110. The water jacket 110 may be of a suitable conventional form of construction. In this regard, water is circulated to the water jacket 110 of a conventional fashion. To this end, as schematically depicted in FIG. 1 water enters the water jacket 110 through inlet means denoted by the reference numeral 112 in FIG. 1 and exits therefrom through the outlet means denoted by the reference numeral 114. It is to be understood that the inlet means 112 is operatively connected in fluid flow relation with a suitable source (not shown) of cooling fluid, e.g., cooling water.

In accord with the best mode embodiment of the invention, the transporter pipe 98 in addition is preferably provided at spaced intervals along the length thereof with a spinner means 116. The latter spinner means 116 each embody a substantially spiral interior surface which is operative to impart a spiral, i.e., spinning action, to the sand particles as they travel through each of the spinner means 116. The effect of imparting this spinning action at periodic intervals to the sand particles is to assist in ensuring that the sand particles maintain their requisite velocity as they travel the length of the transporter pipe 98 and so as to ensure that all sand particles are exposed to the water cooled wall surfaces of the transporter tube 98. A suitable spacing between spinner means 116 has been found to be approximately ten feet. That is, the transporter pipe 98 preferably incorporates a spinner means 116 at each ten foot interval along the length thereof. In this regard as noted herein previously the length of the transporter pipe 98 is a function of the time that the sand particles must be retained in the transporter pipe 98 in order to effect the cooling thereof desired.

After traveling the length of the transporter pipe 98, the reclaimed sand which has undergone cooling within the transporter pipe 98 is discharged therefrom and enters the reclaimed sand storage means 20. The latter storage means 20 may take the form of any. structure of conventional construction suitable for use for this purpose. The reclaimed sand storage means 20 may, if desired, be suitably provided in known fashion with a conventional form of metering means (not shown). More specifically, such a metering means (not shown) may be cooperatively associated with the outlet of the reclaimed sand storage means 20 such as to be operative for controlling the flow of reclaimed sand from the reclaimed sand storage means 20. Further, the metering means (not shown) in turn may be made to operate through the use of any suitable form of means (not shown) such that the reclaimed sand is caused to leave the reclaimed sand storage means 20 at a controlled rate.

Thus, in accordance with the present invention there has been provided a new and improved system for treating solid, granular and aggregate material which embodies therein reclaimer means for effecting the thermal removal of matter of material. Moreover, a new and improved form of thermal reclaimer means is provided which comprises a first portion of a unitary structure that in turn constitutes one of the operating components of a system for treating solid, granular and aggregate material to effect the thermal removal of matter therefrom. In addition, in accord with the present invention a new and improved form of heat exchanger means is provided which comprises a second portion of which a thermal reclaimer means forms the first portion of a unitary structure that in turn constitutes one of the operating components of a system for treating solid, granular and aggregate material to effect the thermal removal of matter therefrom. Further, a new and improved combination thermal reclaimer and sand-to-sand heat exchanger apparatus is provided which is particularly suited for employment in a system for treating solid, granular and aggregate material to effect the thermal removal of matter therefrom. Additionally, in accordance with the present invention a system embodying a new and improved combination thermal reclaimer and sand-to-sand heat exchanger apparatus is provided which is characterized in that significant energy savings are capable of being realized therewith and in that the elimination can be had therewith of some of the components that have heretofore been deemed to be essential for the successful operation of prior art forms of thermal reclamation systems. Penultimately, a system for treating solid, granular and aggregate material to effect the thermal removal of matter from the material is provided which embodies a new and improved form of feeder means operative for feeding material in a dispersed manner into a receiving means. Lastly, in accordance with the present invention, a system for treating solid, granular and aggregate material to effect the thermal removal of matter from material is provided which embodies a new and improved combination thermal reclaimer and sand-to-sand heat exchanger apparatus and a new and improved feeder means, and which is characterized in the fact that it is to employ, is reliable in operation, yet is relatively inexpensive to provide.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

What is claimed is:

1. A system for treating solid, granular and aggregate material thermally comprising:

a. material supply means containing a supply of material to be thermally treated;

b. combination thermal reclaimer and heat exchanger means connected in fluid flow relation to said material supply means for receiving material therefrom, said combination thermal reclaimer and heat exchanger means including a multi-chamber rotating unit having inlet means operative as an entrance into said multi-chamber rotating unit for material received from said material supply means, a preheat chamber connected in fluid flow relation with said inlet means for receiving material therefrom and operative to cause material passing therethrough in a first direction to be preheated from a first temperature to a second temperature, an inner tube connected in fluid flow relation with said preheat chamber for receiving preheated material therefrom, said inner tube having burner means cooperatively associated therewith operative for heating material passing through said inner tube in a second direction to a third temperature to thermally treat the material, chamber means connected in fluid flow relation to said inner tube for receiving thermally treated material therefrom and operative for further treating material passing therethrough, and outlet means operative for discharging therethrough treated material from said multi-chamber rotating unit;

c. feeder means connected in fluid flow relation with said combination thermal reclaimer and heat exchanger means for receiving thermally treated material therefrom, said feeder means being operative for effectuating the feeding of material in a dispersed manner;

d. cooling and transporting means cooperatively associated with said feeder means for receiving material being fed therefrom, said cooling and transporting means being operative to cool the material received thereby to a predetermined temperature as the material is being transported therethrough; and e. material receiving means connected in fluid flow relation with said cooling and transporting means for receiving material at said predetermined temperature therefrom.

2. The system as set forth in claim 1 wherein said material supply means comprises a storage silo.

3. The system as set forth in claim 2 wherein said inlet means of said multi-chamber rotating unit comprises a receiver bin and a scoop-like member, said receiver bin being operative to temporarily store therein material received from said storage silo, said scoop-like member being operative to remove a fixed amount of material from said receiver bin per revolution of said multi-chamber rotating unit.

4. The system as set forth in claim 3 wherein said multi-chamber rotating unit further includes a tube having one end thereof connected in fluid flow relation to said scoop-like member and the other end thereof connected in fluid flow relation to said preheat chamber, said tube being operative as a passage for material from said scoop-like member to said preheat chamber.

5. The system as set forth in claim 4 wherein said multi-chamber rotating unit further includes a transfer channel having one end thereof connected in fluid flow relation with said preheat chamber and the other end thereof connected in fluid flow relation with said inner tube, said transfer channel being operative as a passage for material from said preheat chamber to said inner tube.

6. The system as set forth in claim 5 wherein said chamber means comprises a first central chamber and a second central chamber, said first central chamber having one end thereof connected to said inner tube and the other end thereof connected to one end of said second central chamber, said second central chamber having the other end thereof connected to said outlet means, said first central chamber being operative as a passage for material from said inner tube to said second central chamber, said second central chamber being operative as a passage for material from said first central chamber to said outlet means.

7. The system as set forth in claim 6 wherein said feeder means includes a housing having a mouth-like portion operative for receiving material from said combination thermal reclaimer and heat exchanger means, a fluidized bed portion operative for imparting fluidizing motion to material passing therethrough, baffle means operative as a means for channeling material in accordance with a predetermined path through said housing, and guide means for guiding material into said cooling and transporting means.

8. The system as set forth in claim 7 wherein said cooling and transporting means includes a transporter pipe cooperatively associated with said guide means of said feeder means, said transporter pipe being operative for transporting material received in said transporter pipe from said feeder means to said material receiving means.

9. The system as set forth in claim 8 wherein said material receiving means comprises material storage means.

10. A combination thermal reclaimer and heat exchanger apparatus for treating solid, granular and aggregate material thermally comprising:

a. inlet means operative for feeding into the combination thermal reclaimer and heat exchanger apparatus the material that is to be treated therewithin in such a manner as to ensure that a proper seal is maintained therebetween at all times so as to thereby prevent fumes and odors from escaping from the combination thermal reclaimer and heat exchanger apparatus while material is being fed thereinto, said inlet means including a receiver bin and a scoop-like member, said receiver bin being operative to temporarily store material therein, said scoop-like member being operative to periodically remove from said receiver bin a fixed amount of material and to feed the fixed amount of material into the combination thermal reclaimer and heat exchanger apparatus;

b. a preheat chamber connected in fluid flow relation with said inlet means for receiving material therefrom and operative to cause material passing therethrough in a first direction to be preheated from a first temperature to a second temperature;

c. a tube having one end thereof connected in fluid flow relation to said scoop-like member and the other end thereof connected in fluid flow relation to said preheat chamber, said tube functioning as a passage for material being fed from said scoop-like member to said preheat chamber;

d. an inner tube coaxially aligned with said preheat chamber and connected in fluid flow relation therewith for receiving preheated material therefrom, said inner tube having burner means cooperatively associated therewith and operative for heating material passing in a second direction through said inner tube to a third temperature to thermally treat the material;

e. a transfer channel having one end thereof connected in fluid flow relation with said preheat chamber and the other end thereof connected in fluid flow relation with said inner tube, said transfer channel functioning as a passage for material being fed from said preheat chamber to said inner tube;

f. chamber means connected in fluid flow relation with said inner tube for receiving therefrom thermally treated material and operative for effecting the further treatment of material passing therethrough, said chamber means including a first central chamber and a second central chamber, said first central chamber and said second central chamber each being coaxially aligned with said preheat chamber and said inner tube, said first central chamber having one end thereof connected to said inner tube for receiving thermally treated material from said inner tube and the other end thereof connected to said second central chamber for feeding material to said second central chamber from said first central chamber, said first central chamber being operative to cause the material to undergo further thermal treatment as the material passes through said first central chamber in a direction opposite to the direction of material flow through said inner tube, said second central chamber being operative to cause a direct heat exchange to occur between the material flowing through said second central chamber and the material flowing through said preheat chamber in a direction opposite to the direction of material flow through said second central chamber such that the material flowing through said second central chamber is subjected to cooling and the material flowing through said preheat chamber is subjected to preheating; and g. outlet means connected in fluid flow relation with the other end of said second central chamber and operative for discharging therethrough treated material from the combination thermal reclaimer and heat exchanger apparatus.

11. A feeder device for effectuating the feeding of material in a dispersed manner comprising: a housing having a bottom wall surface and a top wall surface, said housing including a mouth-like portion for receiving material, said mouth-like portion being defined by a plurality of side wall members, a fluidized bed portion operatively connected to said mouth-like portion for receiving material therefrom, said fluidized bed portion including a plurality of fluidizing pipes supported therewithin so as to extend in a first direction, said plurality of fluidizing pipes being operative to discharge a fluidizing medium therefrom in such a manner as to cause material passing through said fluidizing bed portion to have a fluidizing motion imparted thereto, a first baffle mounted in said housing so as to extend coextensively with one of said plurality of said wall members of said mouth-like portion and so as to be spaced from said bottom wall surface of said housing, said first baffle being operative to channel the path of flow of material through said housing, a second baffle mounted in spaced relation to said first baffle and so as to lie in a plane extending perpendicular to the plane of said bottom wall surface of said housing, said second baffle extending from said bottom wall surface of said housing and terminating short of said top wall surface of said housing, said second baffle being operative to further channel the path of flow of material through said housing, and guide means operative for feeding material from said housing in form of thin sheets of material.

* * * * *